US006830165B2

(12) United States Patent
Tanaka

(10) Patent No.: US 6,830,165 B2
(45) Date of Patent: Dec. 14, 2004

(54) NEEDLE THREADER WITH HEIGHT ADJUSTABLE THREAD PUSHER

(75) Inventor: Atsushi Tanaka, Osaka (JP)

(73) Assignee: Clover Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/401,256

(22) Filed: Mar. 27, 2003

(65) Prior Publication Data

US 2004/0026470 A1 Feb. 12, 2004

(30) Foreign Application Priority Data

Aug. 8, 2002 (JP) ..... 2002-230943

(51) Int. Cl.[7] ..... D05B 87/00
(52) U.S. Cl. ..... 223/99
(58) Field of Search ..... 223/99

(56) References Cited

U.S. PATENT DOCUMENTS 2,195,571 A * 4/1940 Jauch ..... 223/99
2,338,159 A * 1/1944 Appleton ..... 223/99
2,490,883 A * 12/1949 Pinkham et al. ..... 223/99
2,507,370 A * 5/1950 Edwards ..... 223/99
2,679,959 A * 6/1954 Ullisperger Sr. et al. ..... 223/99
2,769,959 A * 11/1956 Ullisperger Sr. et al. ... 324/144
2,777,623 A * 1/1957 Balzer ..... 223/99
4,911,341 A * 3/1990 Davis ..... 223/99
4,913,325 A * 4/1990 Cacicedo ..... 223/99
6,045,016 A 4/2000 Okada

FOREIGN PATENT DOCUMENTS

JP 2000-051561 2/2000

* cited by examiner

*Primary Examiner*—Rodney M. Lindsey
*Assistant Examiner*—James G Smith
(74) *Attorney, Agent, or Firm*—Merchant & Gould P.C.

(57) ABSTRACT

A needle threader is provided with a needle holder for holding a needle, and a pusher for inserting a thread into the eye of the needle. The pusher is horizontally movable in forward and backward directions relative to the needle holder. By the forward move, the pusher comes into contact with the needle accommodated in the needle holder. The pusher is movable longitudinally of the needle as held in sliding contact with the needle.

8 Claims, 15 Drawing Sheets

NEEDLE THREADER WITH HEIGHT ADJUSTABLE THREAD PUSHER

BACKGROUND OF THE INVENTION

1. Field of the Invention

The present invention relates to a needle threader for facilitating the insertion of a thread into the eye of a needle.

2. Description of the Related Art

A conventional needle threader is disclosed in JP Laid-open No. 2000-51561, for example. As shown in FIG. 15 of the accompanying drawings of the present application, the conventional needle threader includes two needle holders 91 provided on the main body 90. Each needle holder 91 has a trunk 91*b* formed with a needle receiving hole 91*a* for insertion of a needle 8. On a prescribed side of the trunk is provided a groove 92 for positioning a thread T. The main body 90 is provided with an operating member 93 and a pair of pushers 94. When the operating member 93 is pushed down in the direction shown by an arrow Na, each of the pushers 94 rotates about a shaft 95 in the direction shown by an arrow Nb, and advances towards the needle holder 91. Consequently, as shown in FIG. 16, the thread T is pushed by the pusher 94 to pass through the eye 80 of the needle 8.

While being functional in several respects, the conventional needle threader suffers the following drawbacks.

Generally, sewing needles come in various sizes, and the location and size of the needle eyes usually differ. Specifically, as shown in FIG. 17, a diametrically small needle 8A tends to have a small eye 80A, and the distance s1 between the head end and the eye 80A is short. On the other hand, a diametrically greater needle 8B may have a large eye 80B, and the distance s2 between the head end and the eye 80B is relatively long.

In the prior art, the forward path of the pusher 94 to push the thread T toward the needle holder 91 is permanently fixed. Thus, the insertion of the thread into the eye 80 may fail if a change is made in the height of the eye 80 of the needle 8 set in the needle holder 91.

In light of the above, the prior art is provided with two sets of threading mechanisms each including the combination of a pusher 94 and a needle holder 91, one set being arranged for a thick needle, and the other for a thin needle, so that either one of the needles is properly threaded.

However, providing a plurality of threading mechanisms increases the number of components in the threader as a whole, thereby complicating the overall structure and resulting in a higher production cost. Also, it allows the threader to become bulky and renders inconvenient to be stored or carried. Further, in case where a small needle is inserted into the larger needle holder by mistake, the thread cannot be passed through the needle's eye, which forces the user to reset the needle into the other needle holder for thinner needles. Particularly, since the user has difficulties in deciding which one of the needle holders 91 is suitable for a needle to be threaded, the above troublesomeness becomes more conspicuous.

SUMMARY OF THE INVENTION

The present invention has been proposed under the circumstances described above. It is, therefore, an object of the present invention to provide a needle threader that can deal with needles of various sizes, with a single or reduced number of threading mechanisms, whereby the overall structure is simplified and the convenience is improved.

According to the present invention, there is provided a needle threader comprising: a needle holder for holding a needle; and a pusher for inserting a thread into an eye of the needle, the pusher being movable in a forward direction toward the needle holder and in a backward direction opposite to the forward direction. The pusher is movable longitudinally of the needle while the pusher is held in sliding contact with the needle.

Preferably, the needle threader of the present invention may further comprise a pusher guide for guiding the pusher, wherein the pusher guide changes its position for causing the pusher to move longitudinally of the needle.

Preferably, the needle threader of the present invention may further comprise a working mechanism provided with an operation lever for operating the pusher, wherein the operation lever continues to be operated after the pusher comes into contact with the needle, so that the pusher guide causes the pusher to move longitudinally of the needle.

Preferably, the needle threader of the present invention may further comprise an elastic member arranged between the operation lever and the pusher. The elastic member permits further operation of the operation lever after the pusher is brought into contact with the needle.

Preferably, the needle holder may comprise a needle receiving hole for vertically holding the needle. The needle holder may be formed with a pusher path extending across the needle receiving hole for allowing the passage of the pusher across the needle receiving hole.

Preferably, the pusher path may be large enough to allow the pusher to move longitudinally of the needle.

Preferably, the pusher may undergo a first forward move and a second forward move subsequent to the first forward move. The pusher may advance horizontally from an initial position to the needle during the first forward move, while the pusher may ascend during the second forward move.

Preferably, the pusher may undergo a first backward move subsequent to the second forward move and a second backward move subsequent to the first backward move. The pusher may retreat horizontally during the first backward move to pull out of the eye of the needle, while the pusher may descend during the second backward move to return to the initial position.

Preferably, the needle threader of the present invention may further comprise a needle presser that is horizontally reciprocative for selectively pressing the needle against a wall surface of the needle receiving hole.

Preferably, the pressing of the needle by the needle presser may be performed before the pusher comes into contact with the needle.

Other features and advantages of the present invention will become apparent from the detailed description given below with reference to the accompanying drawings.

BRIEF DESCRIPTION OF THE DRAWINGS

FIG. 6A is a view illustrating the basic parts of an arm and a guide for providing a working mechanism, while

DETAILED DESCRIPTION OF THE PREFERRED EMBODIMENTS

Preferred embodiments of the present invention will be described below with reference to the accompanying drawings.

Figure 1:
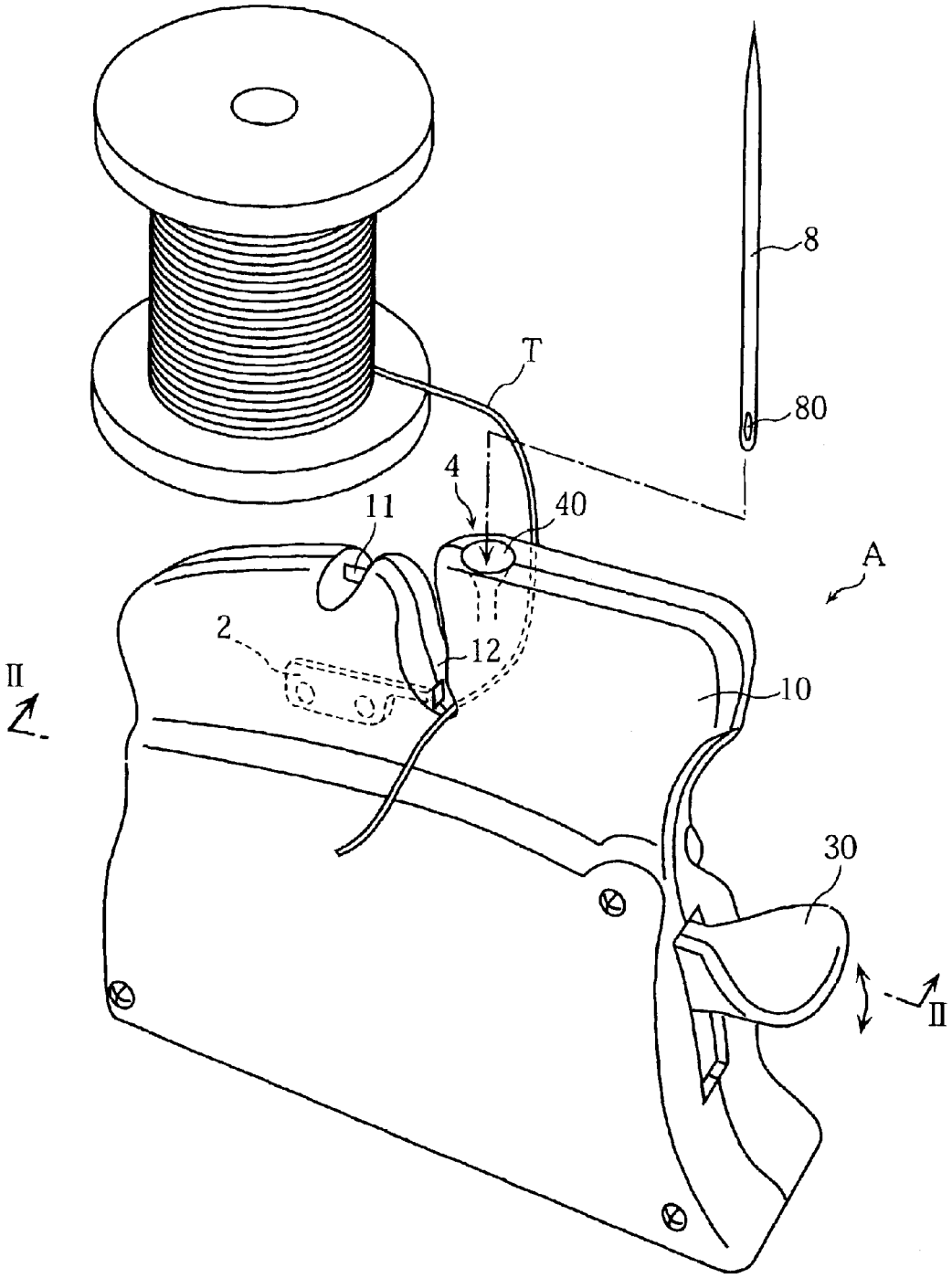
FIG. 1 is a perspective view showing an example of a needle threader embodying the present invention.
Figure 2:
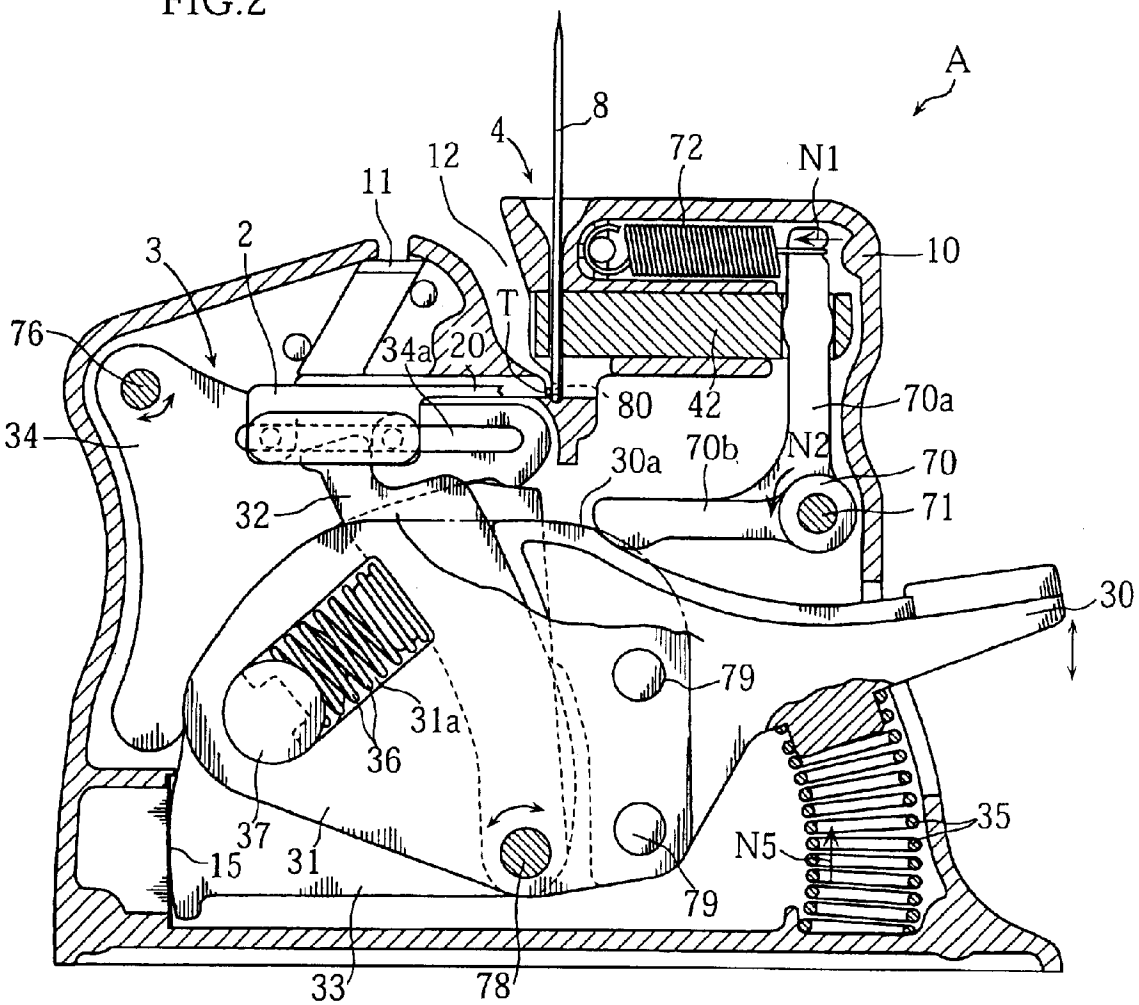
FIG. 2 is a sectional view taken along II—II in FIG. 1.

FIGS. 1 through 12 show a needle threader in accordance with an embodiment of the present invention. The needle threader A of this embodiment has an appearance shown in FIG. 1, where a working mechanism 3 shown in FIG. 2 is incorporated in a synthetic resin housing 10 for operation of a pusher 2.

The housing 10 includes a side surface from which an operation lever 30 for operating the working mechanism 3 protrudes. An upper region of the housing 10 is provided with a needle holder 4 for holding a needle 8 in an upstanding posture, a cutter 11 for cutting a thread T, and a valley 12. When the needle threader A is used, a part of the thread T is set to be caught by the bottom of the valley 12.

Figure 3A:
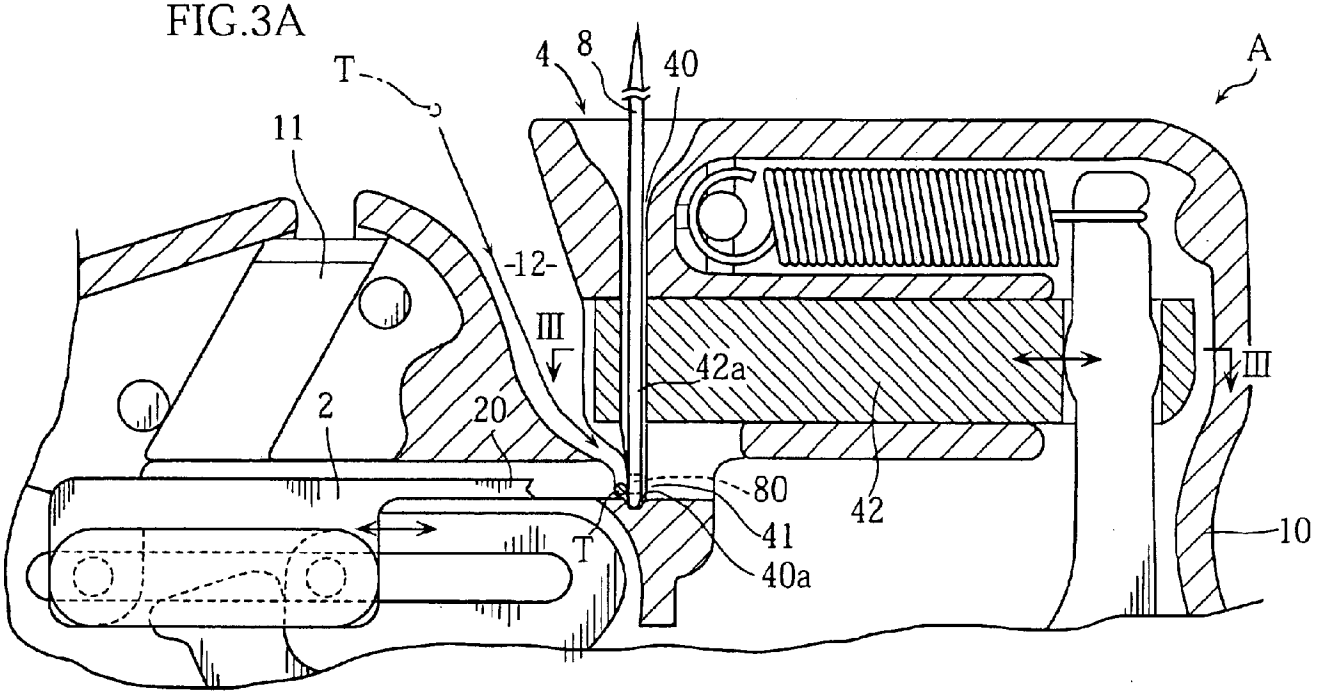
FIG. 3A is an enlarged fragmentary sectional view of FIG. 2.

As best shown in FIG. 3A, the needle holder 4 includes a needle receiving hole 40 with a supporting surface 40*a* at its bottom, a pusher path 41, and a needle presser 42. The needle receiving hole 40 extends in an up-and-down direction (in a vertical direction) to be open in the upper surface of the housing 10. The needle receiving hole 40 receives the needle 8 with its head (the end formed with an eye 80) positioned below. The needle receiving hole 40 has an inner diameter great enough to accommodate needles of the largest type among several ordinary types used for sewing or handicraft-making purposes.

The supporting surface 40*a* is provided for supporting the head of the needle 8. The supporting surface 40*a* is configured as a concave, curved surface. Generally, the eye-formed head of a needle is rendered flat. The supporting surface 40*a* comes into contact with the flattened needle head, thereby correcting the orientation of the needle so that the needle's eye faces to the pusher 2. The pusher path 41 extends across the needle receiving hole 40 and allows the end stick 20 of the pusher 2 to go across the needle receiving hole 40. As described later, the pusher 2 not only reciprocates horizontally but moves upward and downward. In light of this, the vertical size of the pusher path 41 is greater than the vertical thickness of the end stick 20 of the pusher 2.

The needle presser 42 is provided for holding the needle 8 in place by pressing the needle 8 against an inner wall of the needle receiving hole 40. The needle presser 42 may be made of synthetic resin, for example, and is formed with a hole 42*a* communicating with the needle receiving hole 40. The needle 8 is set to extend through the hole 42*a*. The needle presser 42 is moved horizontally when the lever 30 is operated.

Figure 4:
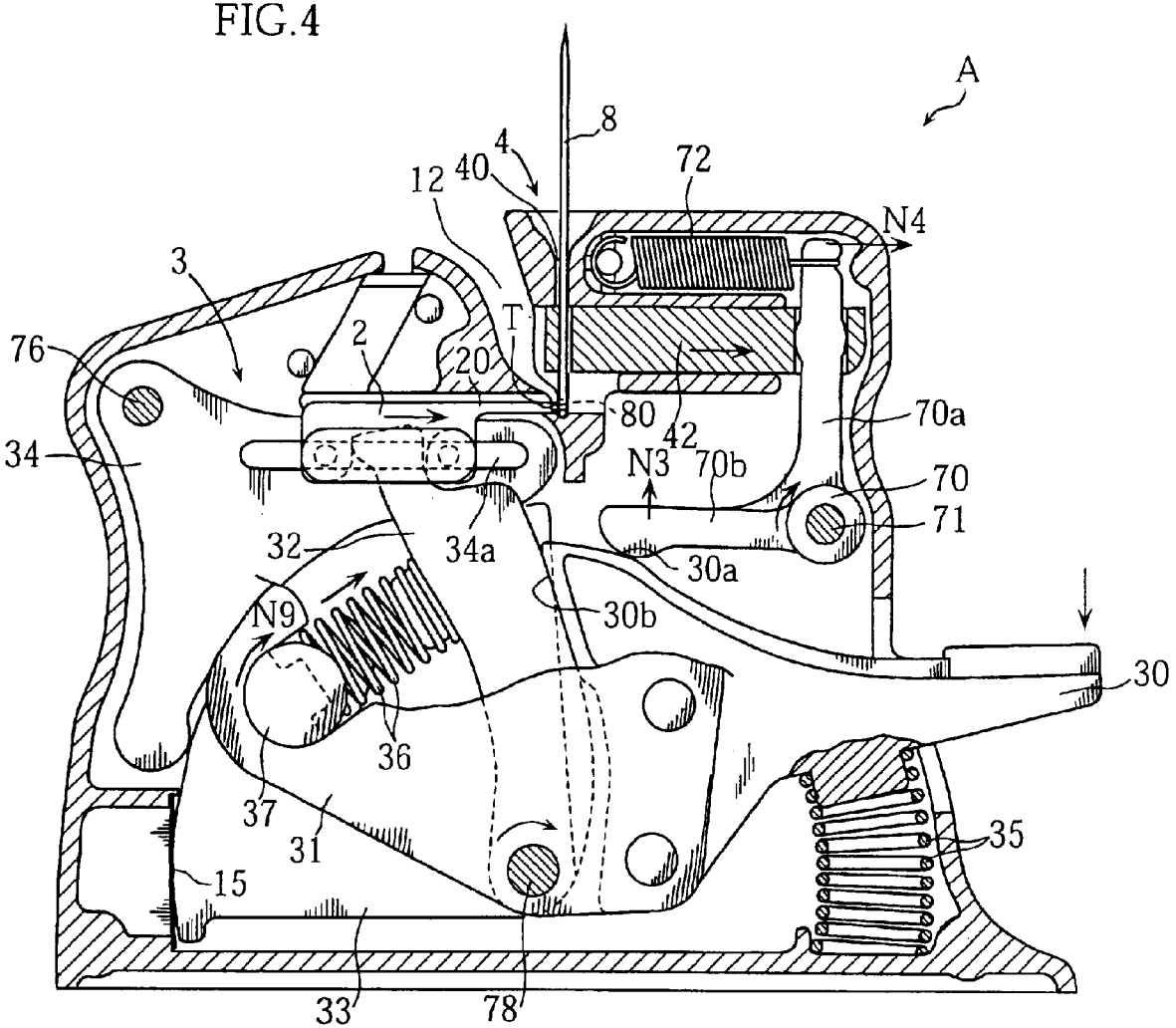
FIG. 4 is a sectional view illustrating the operational state of the needle threader shown in FIGS. 1 and 2.

More specifically, as shown in FIG. 2, an actuator 70 including a first and a second arms 70*a*, 70*b* is rotatably supported by a shaft 71 for operatively linking the operation lever 30 and the needle presser 42. The first arm 70*a*, which passes through a through-hole formed at one end of the needle presser 42, is constantly biased in the arrowed N1 direction by a spring 72. Thus, the actuator 70 tends to be turned in the N2 direction, thereby pressing the second arm 70*b* against the upper surface of the operation lever 30. The upper face of the operation lever 30 is a cam surface formed with a convex 30*a*, and when the operation lever 30 is pushed downward as shown in FIG. 4, the convex 30*a* comes into contact with the second arm 70*b*, whereby the second arm 70*b* rises in the arrowed N3 direction. Consequently, the first arm 70*a* moves in the arrowed N4 direction, together with the needle presser 42 moved in the same direction.

Figure 3B:
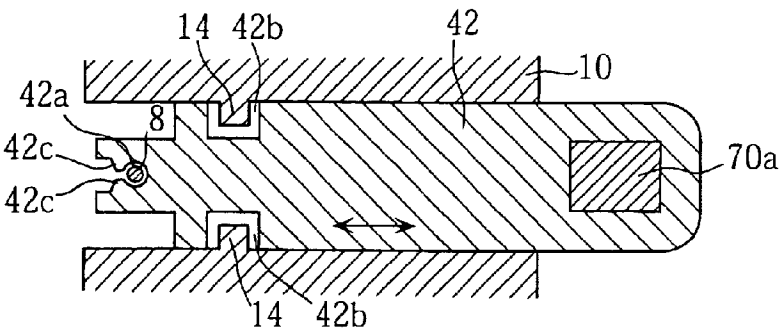
FIG. 3B is a sectional view taken along III—III in FIG. 3A.
Figure 5A:
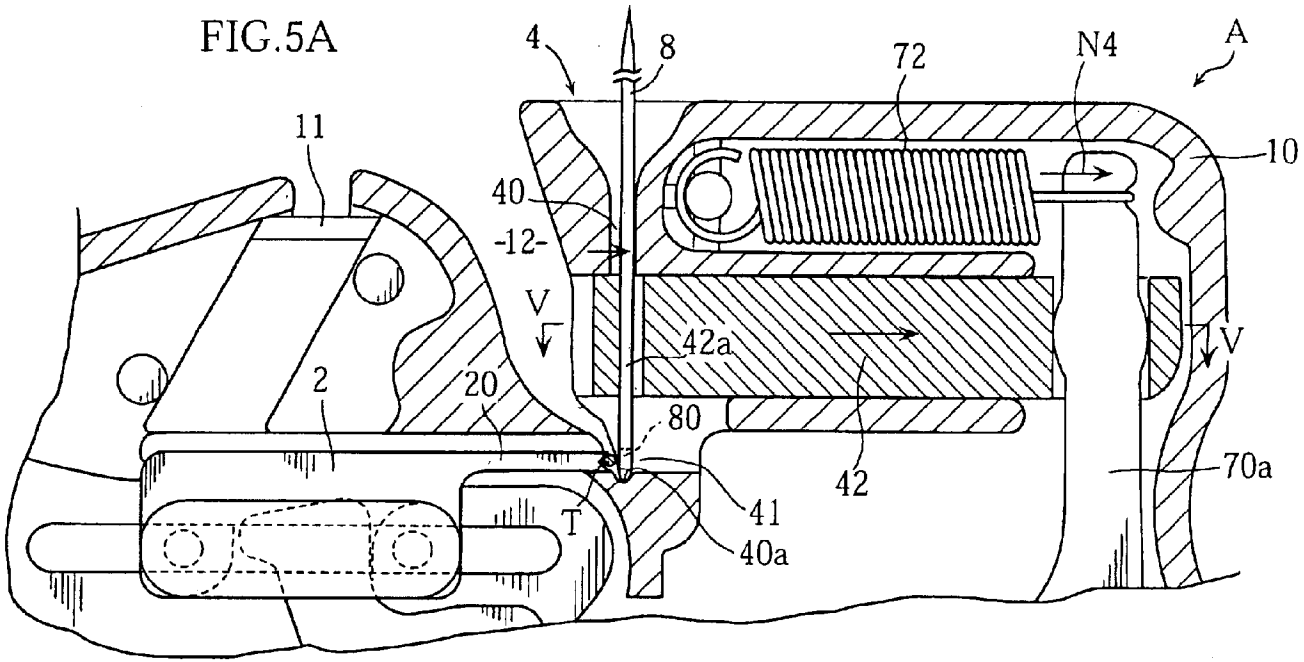
FIG. 5A is an enlarged fragmentary sectional view of FIG. 4.
Figure 5B:
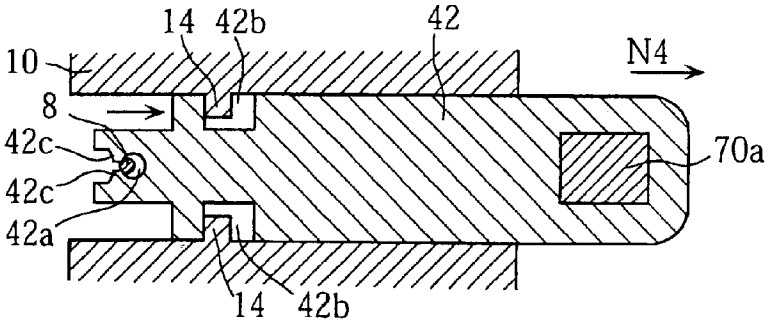
FIG. 5B is a sectional view taken along V—V in FIG. 5A.

When the needle presser 42 moves in the N4 direction, the needle 8 is pressed against the inner wall of the needle receiving hole 40 by the needle presser 42, as shown in FIG. 5A. Referring to FIGS. 5B and 3B, the side surfaces of the needle presser 42 are formed with a concavity 42*b*, in which protrusions 14 of the housing 10 are accommodated. The walls defining the concavities 42*b* come into contact with the protrusions 14 so as to prevent the needle presser 42 from moving with an unduly great stroke or from pushing the needle 8 against the inner wall of the needle receiving hole 40 with unnecessarily great force.

In the needle presser 42, the hole 42*a* is partially cut open in the circumference, and formed with a pair of protrusions 42*c* flanking the opening for pressing the needle 8 against the inner wall of the needle receiving hole 40. With this arrangement, each of the protrusions 42*c* can be elastically deformed in pressing the needle 8 against the inner wall of the needle receiving hole 40. This is advantageous to pressing the needle 8 with an appropriate force regardless of the size of the needle 8. Further, each of the protrusions 42*c* is formed with a curved surface by which the needle 8 is pressed. Thus, when the needle 8 is pushed against the inner wall of the needle receiving hole 40, a positional correction can be made, as viewed perpendicularly to the direction in which the pusher 2 reciprocates, so that the axis of the needle 8 will coincide with the center between the projections 42*c*. As a result, the longitudinal axis of the needle 8 is positioned right in front of the pusher 2, thereby preventing the misalignment between the eye 80 of the needle 8 and the pusher 2 in the direction perpendicular to the reciprocal movement of the pusher 2. When the operation lever 30 is brought back to the original position shown in FIG. 2, the needle presser 42 returns to the original position shown in FIG. 2 and FIGS. 3A, 3B.

The pusher 2 for pushing the thread T into the eye 80 of the needle 8 may be formed by stamping out a thin metal plate into a prescribed form. The end stick 20 of the pusher 2 extends in the prescribed direction to be inserted into the eye 80 of the needle 8. The extremity of the pusher 2 is formed as a concave end so that it does not easily let go of the thread T being pushed.

As shown in FIG. 2, in addition to the operation lever 30, the working mechanism 3 includes an operation plate 31, a swing arm 32, a cam plate 33, a guide 34, and a first and a second springs 35, 36. Among these members, the first and the second springs 35, 36 are coil springs made of metal, whereas the others are made of synthetic resin.

The first spring 35 exerts urging force to push up the operation lever 30 in the arrowed N5 direction. The operation plate 31 is secured to the operation lever 30 by pins 79. The operation plate 31 and the operation lever 30 are integrally rotatable about a shaft 78.

Figure 6A:
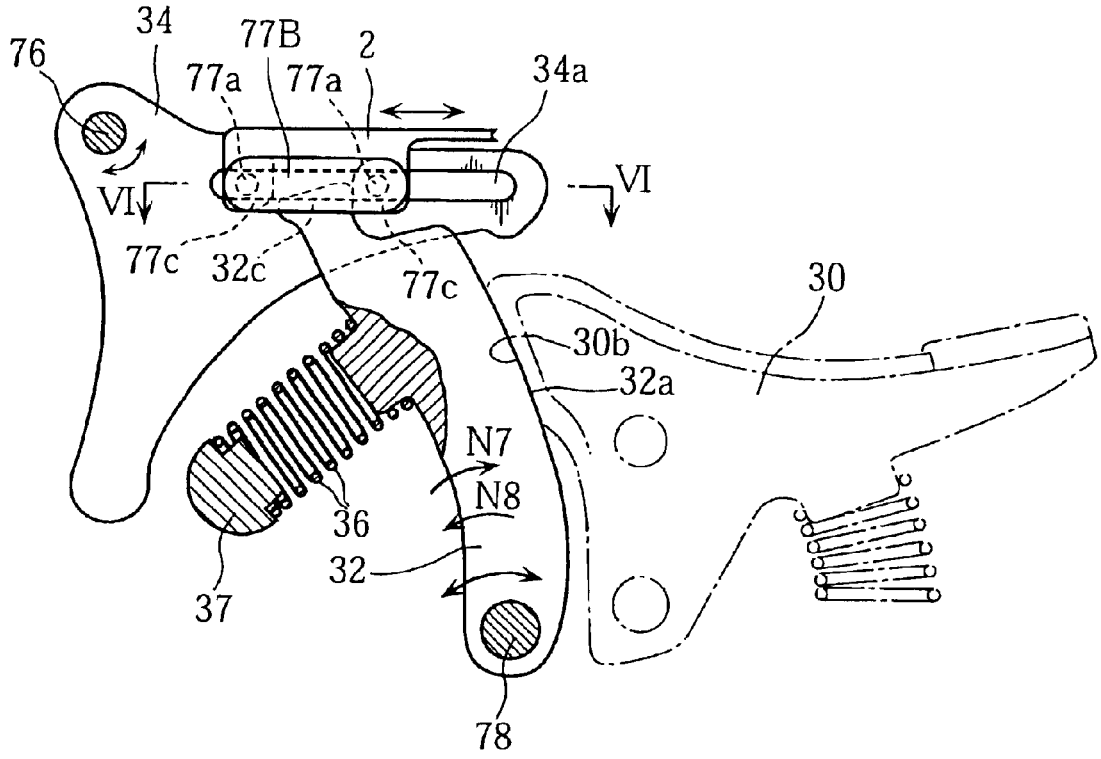
Figure 6B:
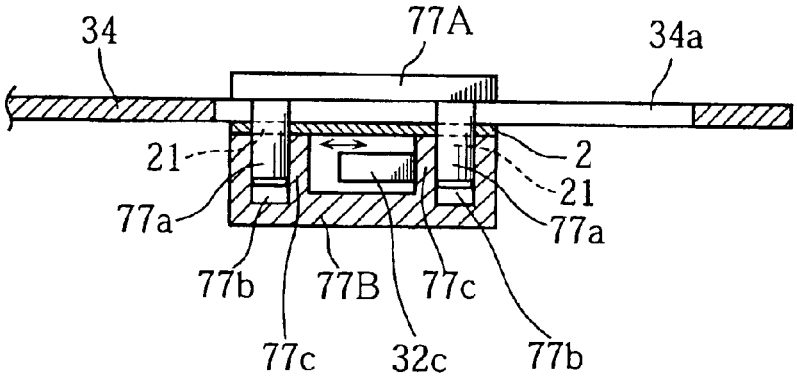
FIG. 6B is a sectional view taken along VI—VI in FIG. 6A.

The guide 34, provided for guiding the pusher 2 in motion, is formed with a straight slit 34*a*, as shown in FIG. 6A. The pusher 2 is attached to the guide 34 in a manner such that it can move reciprocally along the slit 34*a*. As shown in FIG. 6B, this attachment of the pusher 2 is effected by securing members 77A, 77B. The securing member 77A has a pair of projections 77*a* penetrating the slit 34*a* and a pair of holes 21 formed in the pusher 2. These projections 77*a* are fitted in a pair of holes 77*b* formed in the securing member 77B whereby the securing members 77A, 77B clamp to hold the pusher 2.

Referring to FIG. 6A, the swing arm 32 which is pivotally mounted on the shaft 78 moves the pusher 2 reciprocally. A top portion 32*c* of the swing arm 32 enters the region between a pair of walls 77*c* of the securing member 77B, and the swing arm 32 pushes these walls 77*c*, to cause the pusher 2 to reciprocate in the slit 34*a*. As described later, the guide 34 is pivotable about a shaft 76, and the pivoting of the guide 34 determines the moving direction of the pusher 2.

The second spring 36 is disposed between the swing arm 32 and a pin 37, to provide some elasticity between the operation of the lever 30 and the pivoting of the swing arm 32. The pin 37 is configured substantially in a cylinder, but a portion surrounded by the second spring 36 is configured accordingly for that purpose. As illustrated in FIG. 2, the pin 37 is disposed at one side of an opening 31*a* formed in the operation plate 31. Thus, the pin 37 transfers along an arc centered about the shaft 78 in response to the operation of the lever 30. Referring to FIG. 6A, the swing arm 32 is moved in the N7 direction as the pin 37 moves in that direction pushing the swing arm 32 via the second spring 36. A side surface 32*a* of the swing arm 32 faces one side surface 30*b* of the operation lever 30. The rotation of the swing arm 32 in the N8 direction opposite to the above direction is caused by the lever 30 the side surface 30*b* of which pushes the swing arm 32 in that particular direction.

Figure 7A:
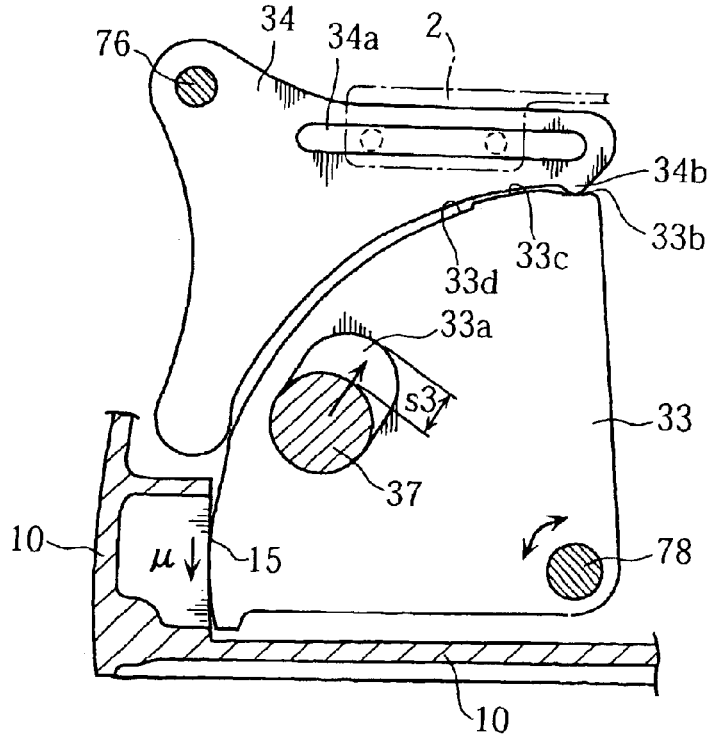
FIGS. 7A and 7B are fragmentary sectional views of a cam plate and a guide for providing the working mechanism.
Figure 7B:
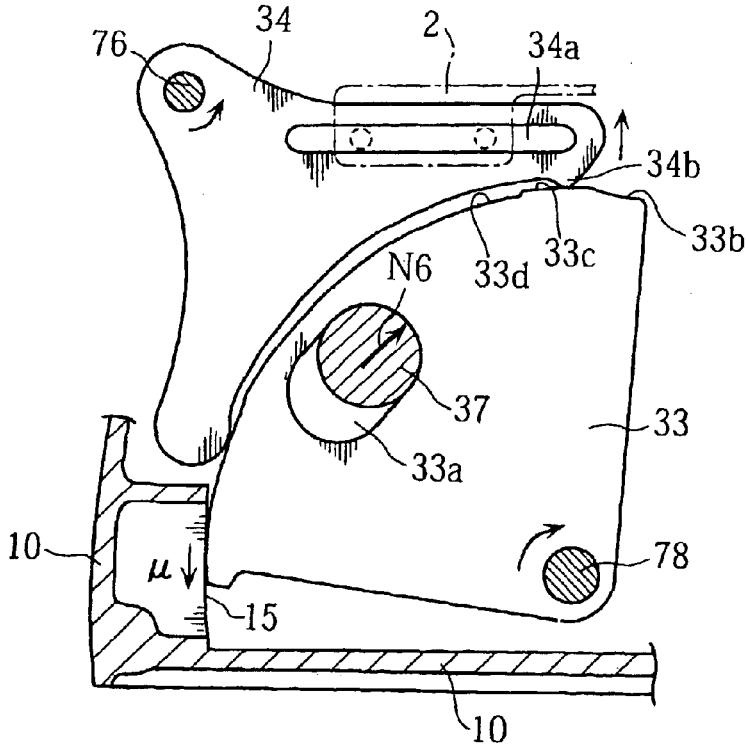

As shown in FIG. 7A, the cam plate 33 is substantially fan-shaped and pivotably mounted on the shaft 78. The cam plate 33 is formed with an opening 33*a* for receiving the pin 37. The opening 33*a* is oval-shaped and allows the pin 37 to make an arc for a certain distance s3 inside thereof. As shown in FIG. 7B, the cam plate 33 moves in the N6 direction when the pin 37 abuts the top of the opening 33*a* thereof and pushes it in that direction. The cam plate 33 moves in the opposite direction when the pin 37 comes to the bottom and pushes it downward. In an ordinary state (i.e. when the lever 30 is not operated), the cam plate 33 is pressed onto a frictional surface 15 near the bottom of the housing 10, and the frictional force $\mu$ in relation to the surface 15 prevents the cam plate 33 from rotating. Thus, supposing that some rotational force is exerted on the cam plate 33, the cam plate 33 does not rotate when the force is weaker than the frictional force u, but begins to rotate upon application of a greater rotational force.

Figure 8:
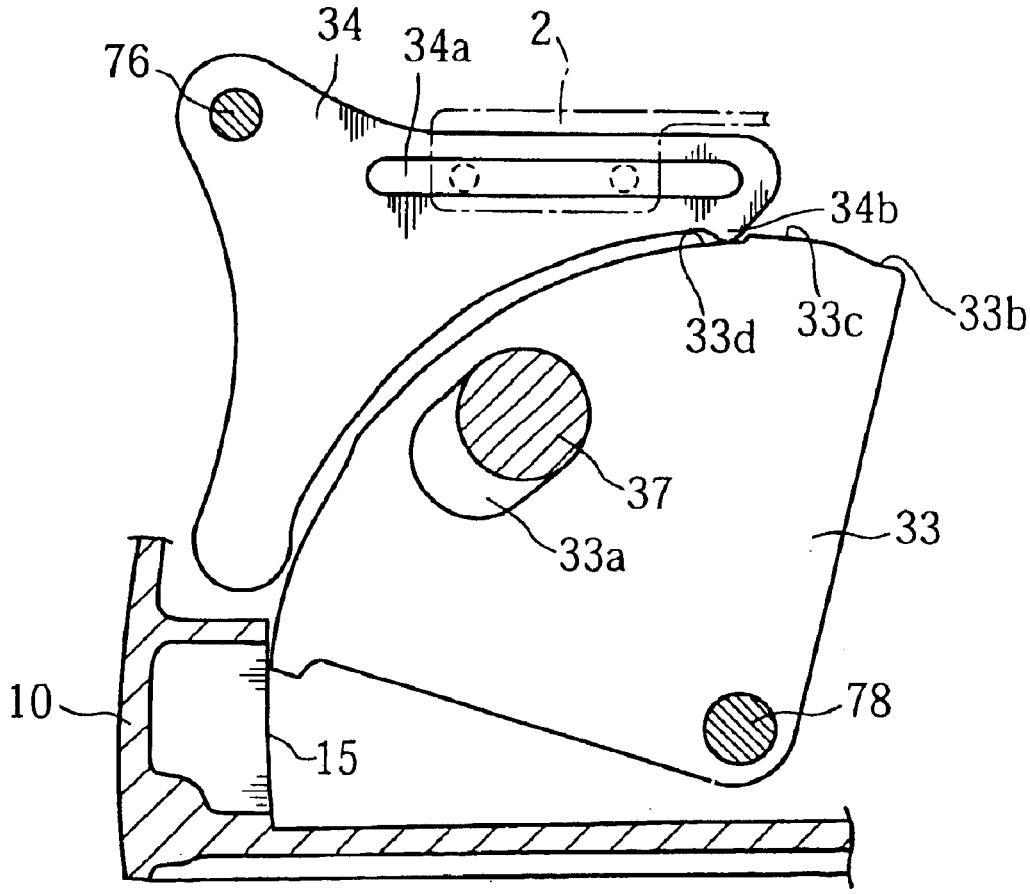
FIG. 8 is a fragmentary sectional view illustrating a cam plate and a guide for providing the working mechanism.

The cam plate 33 includes cam portions 33*b*–33*d* on its outer surface for moving the guide 34. The cam portion 33*c* is flanked by the cam portions 33*b*, 33*d* and raised higher than the cam portions 33*b*, 33*d*. The guide 34 includes a protrusion 34*b* coming into contact with the cam portions 33*b*–33*d*. As shown in FIG. 7A and FIG. 8, when the protrusion 34*b* is on either of the cam portions 33*b* or 33*d*, the guide 34 is held in a position causing the slit 34*a* to extend horizontally. On the other hand, as shown in FIG. 7B, when the protrusion 34*b* is on the cam portion 33*c*, the guide 34 is held in a position causing the slit 34*a* to extend upward to the right in the figure.

Next, how to use the needle threader A and the function thereof will be described.

First, as shown in FIG. 2, a needle 8 is held by the needle holder 8 and a thread T is laid at the bottom of the valley 12. In this state, the operation lever 30 is pushed downward against the elastic force of the first spring 35. Then, as noted above with reference to FIGS. 4 and 5, the convex 30*a* of the operation lever 30 causes the actuator 70 to rotate, and the needle presser 42 is moved in the arrowed N4 direction. As a result, the needle 8 is pushed against the inner wall of the needle receiving hole 40, whereby the needle 8 is positioned so that the axis thereof is located immediately in front of the pusher 2.

In response to the operation of the lever 30, on the other hand, the working mechanism 3 moves the pusher 2 forward to and then backward from the needle holder 4. The operational behavior of the pusher 2 of the working mechanism 3 can be divided into a first operational mode shown in FIG. 9A and a second operational mode shown in FIG. 9B. For better understanding of the specific functions of the working mechanism 3, the general outlines of the first and the second operational modes will be described below.

Figure 9A:
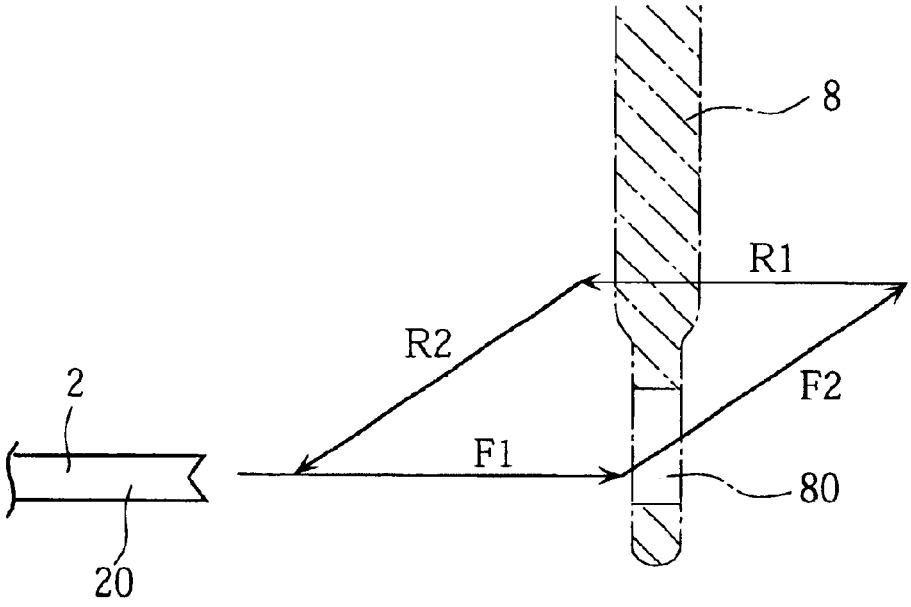
FIGS. 9A and 9B illustrate how the pusher moves.

In the first operational mode shown in FIG. 9A, the end stick of the pusher 2 is held at the same height as the eye 80 of the needle 8 while the pusher 2 is advancing towards the needle 8, whereby the end stick 20 of the pusher 2 is allowed to go straight into the eye 80. The movement of the pusher 2 includes a first and a second forward moves F1, F2 and a first and a second rearward moves R1, R2. In the first forward move F1, the pusher 2 horizontally moves from the initial position shown in FIG. 2 towards the needle 8, whereas in the subsequent second forward move F2, the pusher 2 advances further in a diagonally upward direction. In the first rearward move R1 subsequent to the second forward move F2, the pusher 2 retreats horizontally, while in the second rearward move R2, the pusher 2 retreats further in a diagonally downward direction.

Figure 9B:
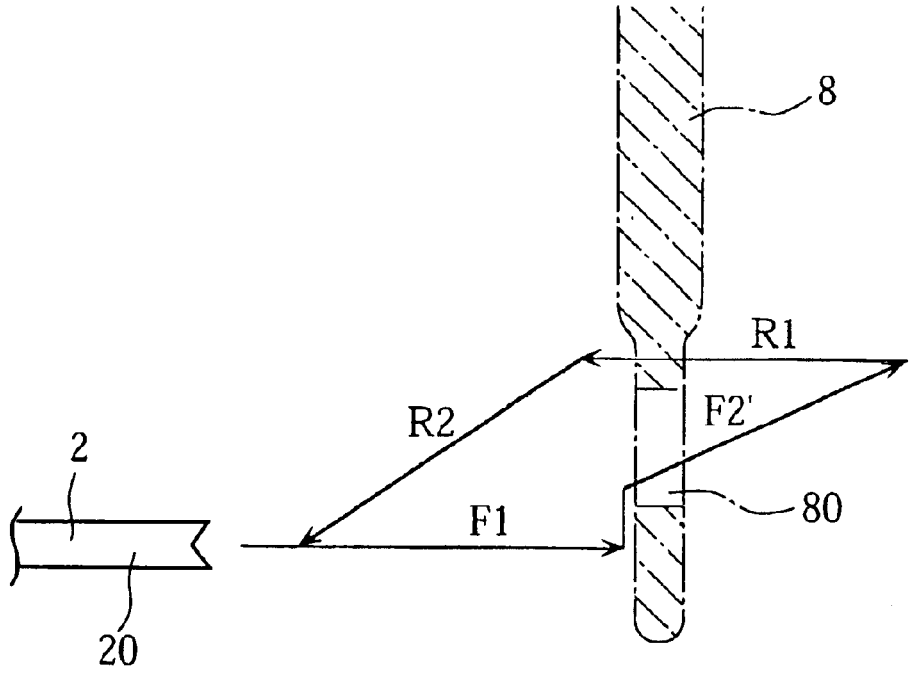

In the second operational mode shown in FIG. 9B, on the other hand, the end stick 20 of the pusher 2 differs in height from the needle eye 80 of the needle 8 as the pusher 2 advances towards the needle 8. As for the movements of the pusher 2, the second forward move F2' is different from the above-described second forward move F2, while the other moves are the same as those in the first operational mode. The second forward move F2' includes an ascent of the pusher 2 sliding on the needle 8, which enables the end stick 20 of the pusher 2 to enter into the eye 80 of the needle 8.

The specific function of the working mechanism 3 will now be explained. Referring to FIG. 4, when the operation lever 30 is pushed downward as shown in FIG. 4, the pin 37 is rotated about the shaft 78 in the N9 direction. As a result, the swing arm 32 is pushed in that direction by the pin 37 via the second spring 36, to be rotated together with the operation lever 30 while being held in contact with a side surface 30*b* of the operation lever 30. This rotation of the swing arm 32 causes the pusher 2 to advance towards the needle 8. At an early moving stage of the pin 37, the pin 37 shifts only in a region of the size s3 within the opening 33*a* of the cam plate 33 shown in FIG. 7A. Thus, at this stage, the cam plate 33 remains stationary, thereby causing the protrusion 34*b* of the guide 34 to keep in contact with the cam portion 33*b* of the cam plate 33, and allowing the slit 34*a* of the guide 34 to be horizontally elongated. Accordingly, the advancement of the pusher 2 is performed horizontally. The horizontal movement of the pusher 2 continues until the end stick 20 of the pusher 2 comes just before the needle 8. This horizontal movement corresponds to the first forward move F1 shown in FIGS. 9A and 9B.

When the operation lever 30 is pushed further down as shown in FIG. 7B, the pin 37 comes into contact with the top of the opening 33*a*, thereby pushing the cam plate 33 in the N6 direction. As a result, the cam portion 33*c* of the cam plate 33 comes into contact with the protrusion 34*b* of the guide 34 whereby the guide 34 is caused to tilt, with the right end raised higher. Meanwhile, the swing arm 32, being pressed by the pin 37 via the second spring 36, continues to rotate, thereby advancing the pusher 2 further.

Figure 10:
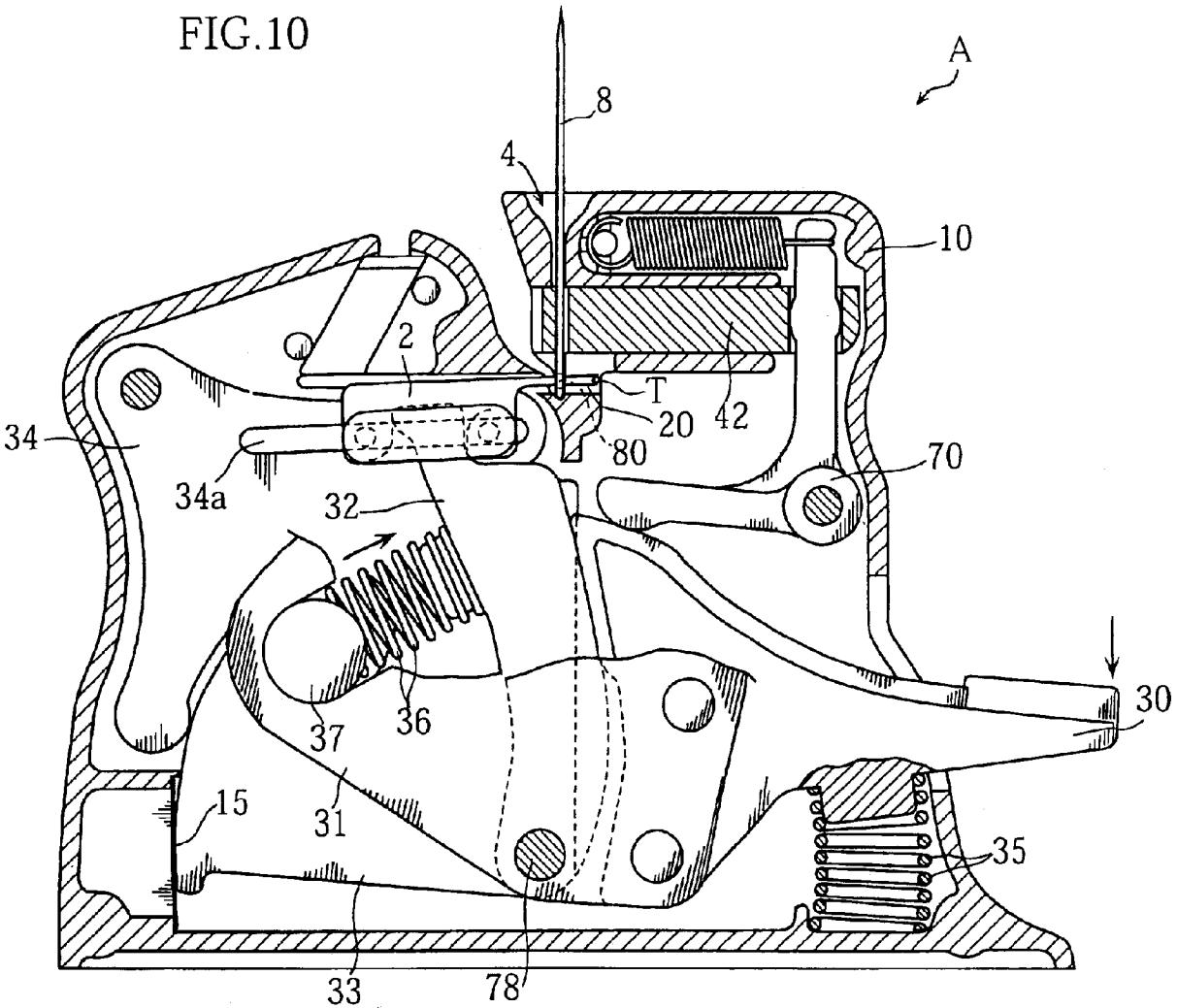
FIG. 10 is a sectional view showing a process step of the needle threader shown in FIGS. 1 and 2.

As seen from the above, if the end stick of the pusher 2 and the eye 80 of the needle 8 are at the same height at the end of the first forward move F1, the second forward move F2 shown in FIG. 9A takes place, where the end stick 20 of the pusher 2 is inserted straight into the eye 80 and then moves diagonally upward. FIG. 10 shows the state where the end stick 20 of the pusher 2 extends through the eye 80. By this movement of the pusher 2, the thread T is passed through the eye 80. For the second forward move F2, the pusher 2 advances upward, and may lift the needle 8 by abutting on the upper edge of the eye 80 of the needle 8, though this lifting does not damage the needle 8. The pusher 2 advances sufficiently after its tip passes through the eye 80. With this arrangement, an appropriate length of thread T is pushed into the eye 80. Thus, the thread T is not easily pulled out of the eye 80 when the needle 8 is taken out from the needle holder 4.

Figure 11:
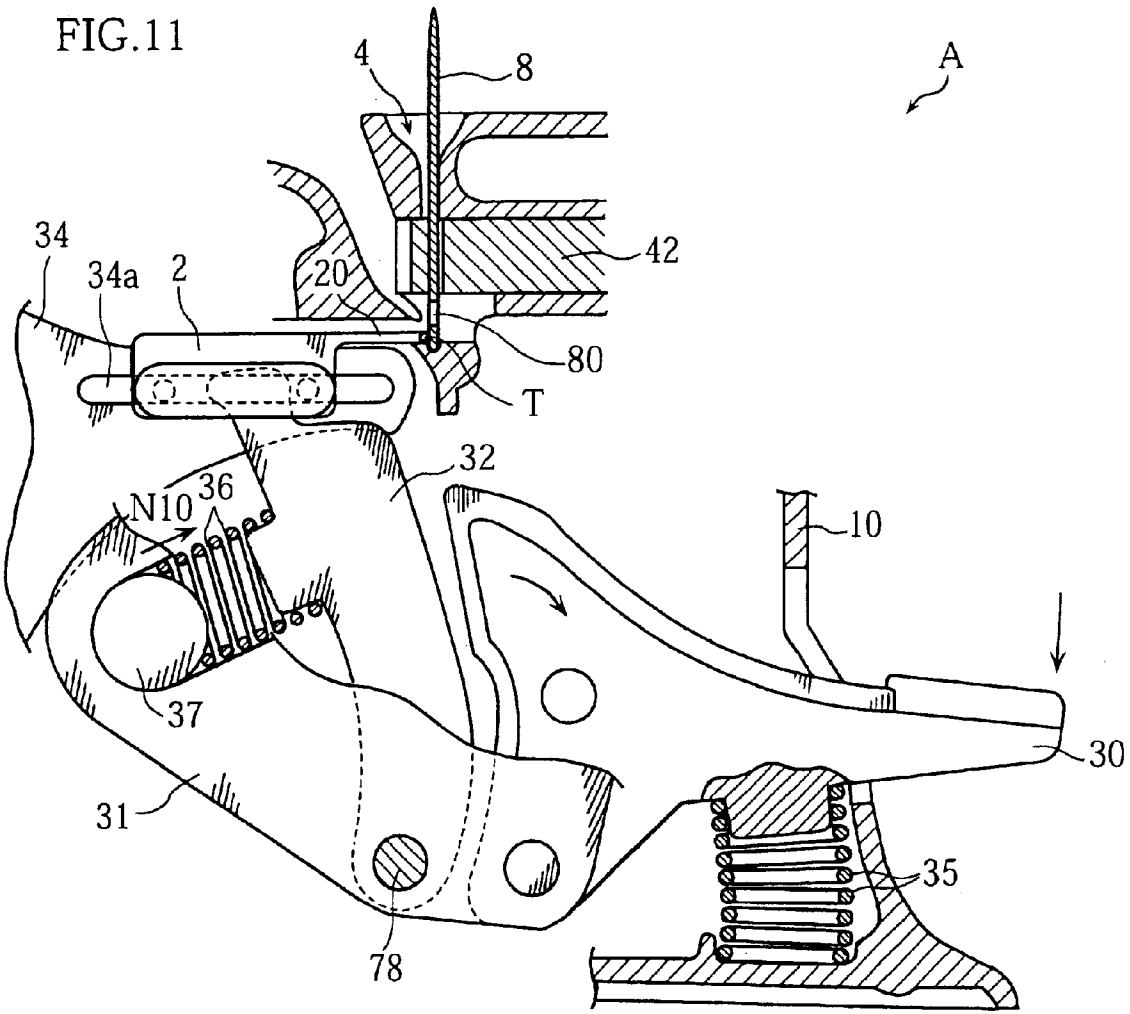
FIG. 11 is a fragmentary sectional view showing a process step of the needle threader shown in FIGS. 1 and 2.

On the other hand, when the pusher 2 is lower than the eye 80 of the needle 8, as shown in e.g. FIG. 11, the end stick 20 of the pusher 2 bumps into the needle 8. When the pusher 2 and the needle 8 abut each other in this manner, the pusher 2 cannot advance any further, nor can the swing arm 32 rotate for moving the pusher 2 forward. However, since the second spring 36 is provided between the swing arm 32 and the pin 37, it is possible to push the operation lever 30 further down. The downward push of the operation lever 30 causes the pin 37 to move in the N10 direction, thereby compressing the second spring 36. When the pin 37 moves in this manner, the slit 34*a* in the guide 34 can be sloped by the pivoting of the cam plate 33, as noted above with reference to FIG. 7B. Thus, in the needle threader A, it is possible to raise the end stick 20 of the pusher 2, while the end stick 20 is held in contact with the needle 8. This elevation enables the end stick 20 to pass through the eye 80 of the needle 8. After being inserted into the eye 80, the end stick 20 of the pusher 2 advances diagonally upward. This movement corresponds to the second forward move F2' shown in FIG. 9B.

As described above, the elevation of the pusher 2 enables the end stick 20 to enter into the eye 80 of the needle threader A even if the height of the end stick 20 is not the same as that of the eye 80 of the needle 8 at the end of the first forward move F1 of the pusher 2. Therefore, when several kinds of needles, having eyes formed at different positions, are prepared and any one of them is set into the needle holder 4, the threading is properly performed with that needle. Unlike the prior art, there is no need to provide a plurality of threading mechanisms specially designed for large or small needles, whereby the whole structure can be simplified and downsized. Before entering into the eye 80, the pusher 2 is moved from a head portion of the needle 8 towards the point upon abutting the needle 8. In light of this, the height of the pusher 2 in approaching the needle 8 may be preset so that the height corresponds to the shortest distance between the crown and the eye among ordinary needles to be threaded.

At the end of the forward move of the pusher 2, the user releases the operation lever 30. Thus, the operation lever 30 is moved upward by the elastic force of the first spring 35, and the swing arm 32 rotates in the direction causing the pusher 2 to retreat. However, when the pusher 2 finishes the second forward move F2 or F2', the cam plate 33 is held in a greatly rotated state by the pin 37, as shown in FIG. 8, so that the protrusion 34*b* of the guide 34 is in contact with the cam face 33*d*. Thus, in an early stage of the retreat of the pusher 2, the slit 34*a* of the guide 34 is horizontal, and the pusher 2 retreats horizontally. This retreat corresponds to the first rearward move R1 shown in FIGS. 9A, 9B, and it continues until the pusher 2 is entirely pulled out of the eye 80 of the needle 8. The horizontal movement of the pusher 2 for pulling out the pusher 2 from the eye 80 ensures smooth removal of the pusher 2 from the eye 80.

Figure 12:
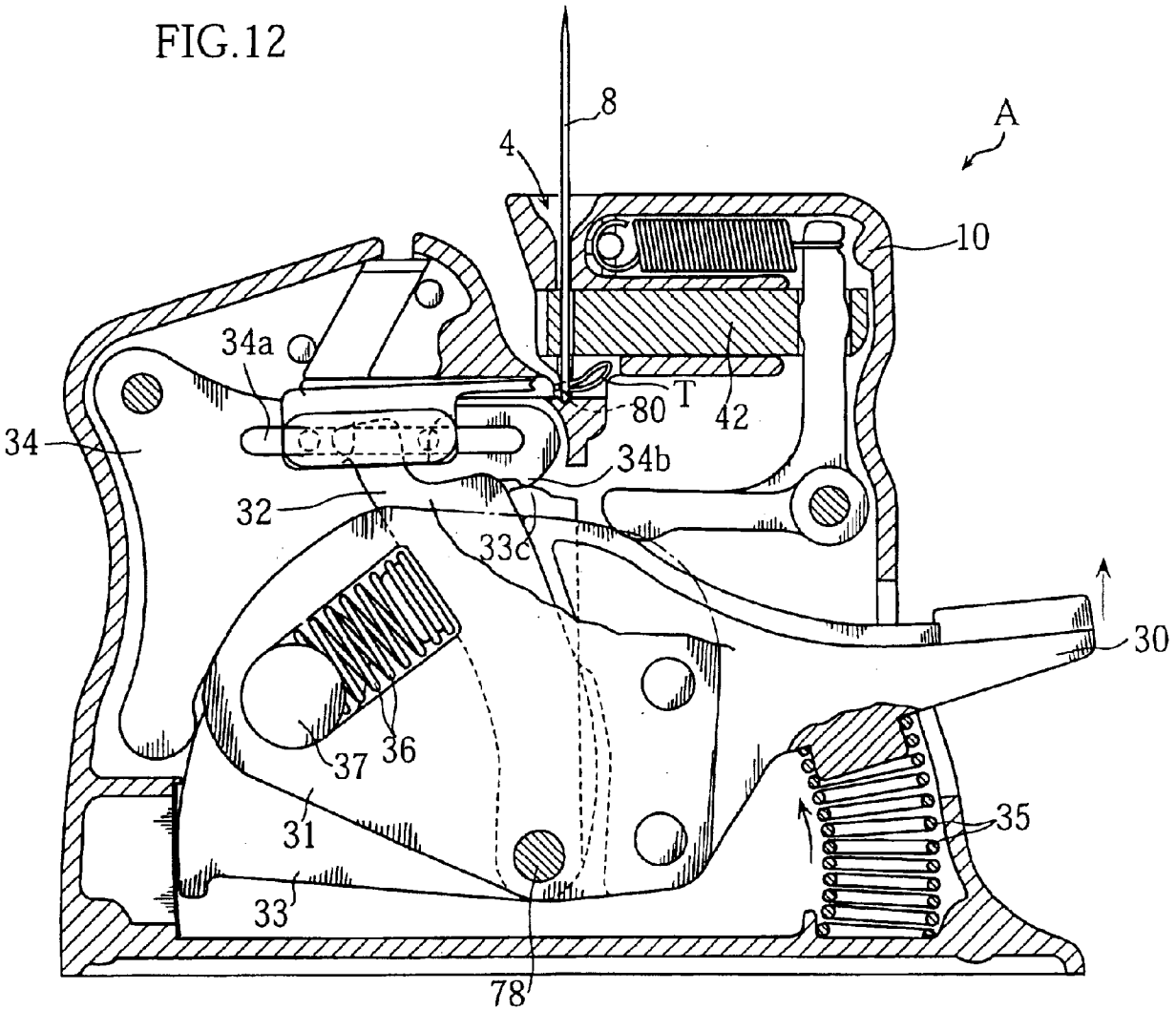
FIG. 12 is a sectional view showing a process step of the needle threader shown in FIGS. 1 and 2.

After the above-described retreat, the operation lever 30 is further moved upward. Thus, the pin 37 pushes down the bottom of the hole 33*a* of the cam plate 33 to rotate the cam plate 33. As shown in FIG. 12, the rotation of the cam plate 33 brings the protrusion 34*b* of the guide 34 into temporary contact with the cam surface 33*c*, whereby the slit 34*a* of the guide 34 is slanted. In this case, the pusher 2 retreats diagonally downward, which corresponds to the second rearward move R2 shown in FIGS. 9A, 9B. Upon completing the second rearward move R2, the pusher 2 returns to the initial height. Thereafter, the pin 37 further presses the cam plate 33 downward, to bring the cam plate 33 to the original position. As the operation lever 30 is restored, the swing arm 32, the pusher 2 and the operation plate 31 also return to their original position or posture shown in FIG. 2.

The upward retreat of the operation lever 30 causes the needle presser 42 to return to the state shown in FIGS. 2 and 3, where the needle 8 is released from the pressure by the needle presser 42 pressing it against the inner surface of the needle receiving hole 40. Therefore, the needle 8 can be pulled up from the needle receiving hole 40, with the inserted thread T remaining in the eye 80.

The above description is of the case where the needle 8 is set properly in the needle receiving hole 4 so that the eye 80 of the needle 8 is aligned exactly with the pusher 2. In an actual use, however, various factors may impede the needle 8 from being properly oriented with the result that the eye 80 and the pusher 2 are misaligned. In such a case, the pusher 2 moves forward upon the operation of the lever 30, until it reaches the needle 8 and then ascends for a predetermined distance, but the threading for the eye 80 is not to be performed. By restoring the operation lever 30, the pusher 2 moves back to the original position. After the pusher 2 abuts on the needle 8, a further downward push on the operation lever 30 compresses the second spring 36, whereby the downward-push force of the operation lever 30 is not conveyed directly to the pusher 2. Consequently, the pusher 2 is unlikely to press the needle 8 with an excessively great force, thereby avoiding a damage to the pusher 2 or to the needle 8.

The present invention is not limited to the embodiments described above. Specific configurations of each component of the needle threader according to the present invention may be varied in many ways.

Figure 13:
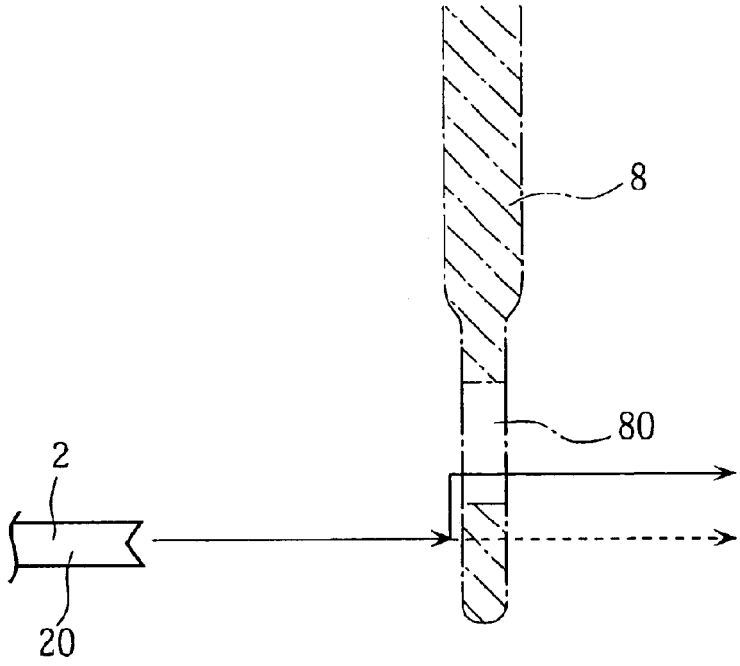
FIG. 13 shows another example of the pusher's move.

According to the present invention, the pusher 2 may be designed to advance horizontally, as shown in FIG. 13, after it reaches the needle 8, ascends along the needle 8, and enters the eye 80. It is not necessary for the pusher 2 of the present invention to go diagonally upward in the forward move. Further, as for the mechanism of causing the pusher 2 to move upward, the guide itself for the pusher 2 may be moved upward, instead of changing only the posture or orientation of the guide.

Figure 14:
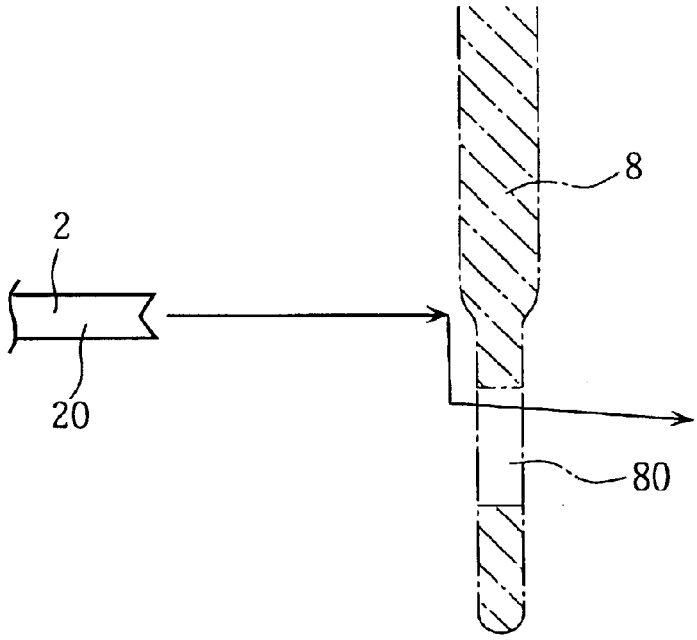
FIG. 14 shows another example of the pusher's move.
Figure 15:
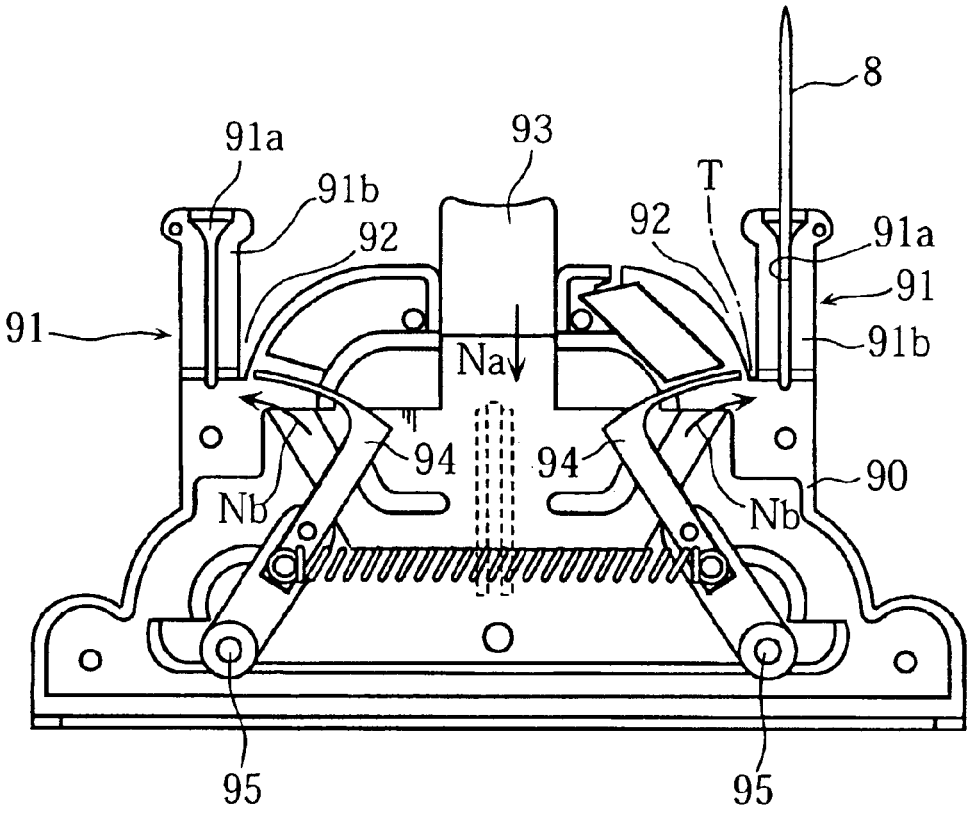
FIG.15 PRIOR ART
FIG. 15 shows a conventional needle threader.
Figure 16:
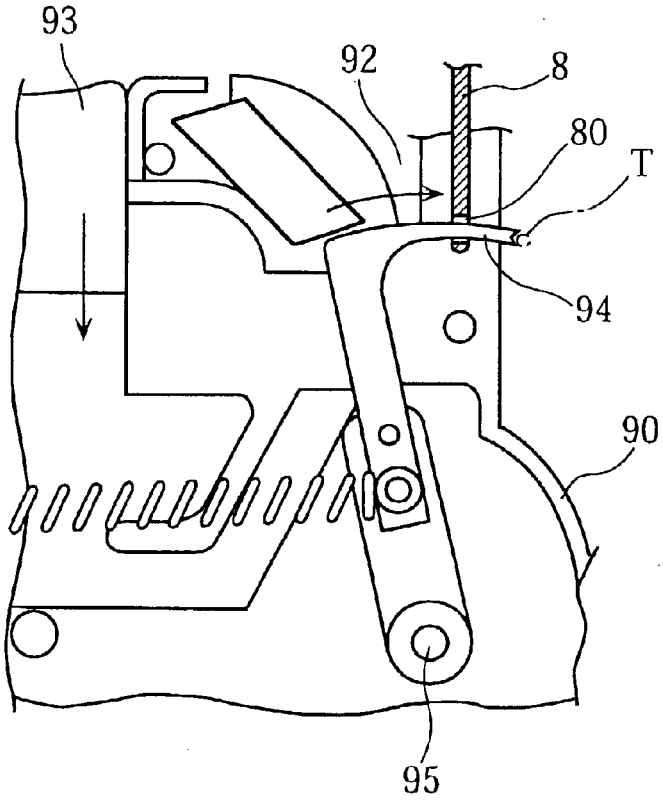
FIG.16 PRIOR ART
FIG. 16 shows a threading step in the conventional needle threader.
Figure 17:
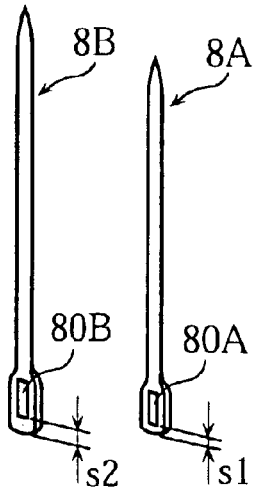
FIG.17 PRIOR ART
FIG. 17 shows conventional needles.

In accordance with present invention, as shown in FIG. 14, the pusher 2 may be designed to descent along the needle 8 to enter the eye 80 of the needle 8 after reaching the needle 8. However, it is preferable to cause the pusher 2 to abut a portion near the head of the needle 8 and move upward toward the point of the needle 8, as in the above-described embodiments. In the manner shown in FIG. 14, the pusher 2 may come to contact with the needle 8 at a cylindrical portion above its head so that the encounter between the pusher 2 and the needle 8 may be unstable. In the above embodiments, on the other hand, the pusher 2 abuts at a flat head portion of the needle 8, so that the pusher 2 can be moved upward properly. In addition, the variations in distance between the head and the bottom edge of a needle eye (the edge closer to the head end) are smaller than those in the distance between the head and the top edge of a needle eye (the edge closer to the point). Therefore, generally the distance the pusher ascends along the needle 8 can be shorter by the above embodiments than otherwise.

In the present invention, various mechanisms may be employed for moving the pusher forward or longitudinally along the needle. The needle holder is not limited to the specific configuration as long as it can hold a needle in a stable posture. As for the pusher, any configuration, size, material may be employed.

The present invention being thus described, it is obvious that the same may be varied in many ways. Such variations are not to be regarded as a departure from the spirit and scope of the present invention, and all such modifications as would be obvious to those skilled in the art are intended to be included within the scope of the following claims.

What is claimed is:

1. A needle threader comprising:

a needle holder for holding a needle;

a pusher for inserting a thread into an eye of the needle, the pusher being movable in a forward direction toward the needle holder and in a backward direction opposite to the forward direction; and a pusher guide for guiding the pusher;

wherein the pusher guide changes a position thereof for causing the pusher to move along a lengthwise direction of the needle together with the pusher guide while the pusher is held in contact with the needle.

2. The needle threader according to claim 1, further comprising a working mechanism provided with an operation lever for operating the pusher, wherein the operation lever continues to be operated after the pusher comes into contact with the needle, so that the pusher moves along the lengthwise direction of the needle.

3. The needle threader according to claim 2, further comprising an elastic member arranged between the operation lever and the pusher, wherein the elastic member permits further operation of the operation lever after the pusher is brought into contact with the needle.

4. A needle threader comprising:

a needle holder for holding a needle; and a pusher for inserting a thread into an eye of the needle, the pusher being movable in a forward direction toward the needle holder and in a backward direction opposite to the forward direction;

wherein the pusher is movable along a lengthwise direction of the needle while the pusher is held in contact with the needle;

wherein the needle bolder includes a needle receiving hole for vertically holding the needle, the needle holder being formed with a pusher path extending across the needle receiving hole for allowing passage of the pusher across the needle receiving hole: and wherein the needle threader further comprises a needle presser that is horizontally reciprocative for selectively pressing the needle against a wall surface of the needle receiving hole.

5. The needle threader according to claim 4, wherein the pusher path is large enough to allow the pusher to move along the lengthwise direction of the needle.

6. The needle threader according to claim 4, wherein the pusher undergoes a first forward move and a second forward move subsequent to the first forward move, the pusher advancing horizontally from an initial position to the needle during the first forward move, the pusher ascending during the second forward move.

7. The needle threader according to claim 6, wherein the pusher undergoes a first backward move subsequent to the second forward move and a second backward move subsequent to the first backward move, the pusher retreating horizontally during the first backward move to pullout of the eye of the needle, the pusher descending during the second backward move to return to the initial position.

8. The needle threader according to claim 4, wherein the pressing of the needle by the needle presser is performed before the pusher comes into contact with the needle.

* * * * *